United States Patent [19]

Farnsworth

[11] 4,024,656

[45] May 24, 1977

[54] GREETING CARD CALENDAR

[76] Inventor: Barbara Farnsworth, P.O. Box 141, Camden, N.Y. 13316

[22] Filed: Apr. 19, 1976

[21] Appl. No.: 678,203

[52] U.S. Cl. ..... 40/121; 40/124.1; 40/152.1

[51] Int. Cl.[2] ..... G09D 3/04

[58] Field of Search ..... 40/107, 119–122, 40/126 A, 152, 152.1, 124.1, 155, 156; 283/2; 46/35

[56] References Cited

UNITED STATES PATENTS

| | | | |
|---|---|---|---|
| 828,984 | 8/1906 | Sweet | 40/152.1 |
| 1,705,116 | 3/1929 | Howland | 40/120 |
| 2,128,989 | 9/1938 | Dickerson | 40/119 |
| 2,504,277 | 4/1950 | Otterson | 40/155 X |
| 3,113,559 | 12/1963 | Friedman | 40/120 X |

*Primary Examiner*—John F. Pitrelli
*Attorney, Agent, or Firm*—Lee A. Strimbeck

[57] ABSTRACT

A greeting card-calendar comprises a single folded sheet of card stock forming a front panel or cover over a back panel. The fold is on the vertical side of the card and the front panel is made to be manually removable from the back panel as by the fold being perforated. The front panel has an aperture. A calendar pad or like tablet is mounted on the back panel so that it can be viewed through the aperture. The calendar pad has a decorative top sheet which when the card is in the closed position is seen through the aperture in the front panel. The back panel is scored and/or die cut to permit it being folded into a triangular easel that mounts and displays the calendar pad.

3 Claims, 4 Drawing Figures

GREETING CARD CALENDAR

THIS INVENTION

This invention pertains to message-carrying cards such as greeting cards and is more particularly concerned with a greeting card calendar that is adapted to having the front portion of the card carrying the message or greeting removed leaving that portion containing the calendar for continued use.

This present invention is particularly concerned with cards for the Christmas season which when the card has served its purpose of conveying the greeting can find use as a calendar for the coming year. While the present card is designed particularly with an eye for use as a desk calendar its use as a flat wall hang-up type calendar is not precluded. Also, while particular reference is made to calendars, this invention emcompasses the use of other types of tablets in the place of the calendars, such as prayer pads, recipe pads, astrology notes, a series of get well messages, etc. "Tablet" as here used means a collection of sheets bound together at one edge.

The present card-tablet is of course eminently suited for carrying advertising messages on the portion of the card that remains and supports the tablet such as the same may be viewed and considered by the recipient of the card during the life of the pad-throughout the year in the case of a calendar.

DRAWINGS

The nature of this invention and its advantages will become clear by the following description made with reference to the drawings attached to and made a part hereof, in which.

DESCRIPTION

Figure 1:
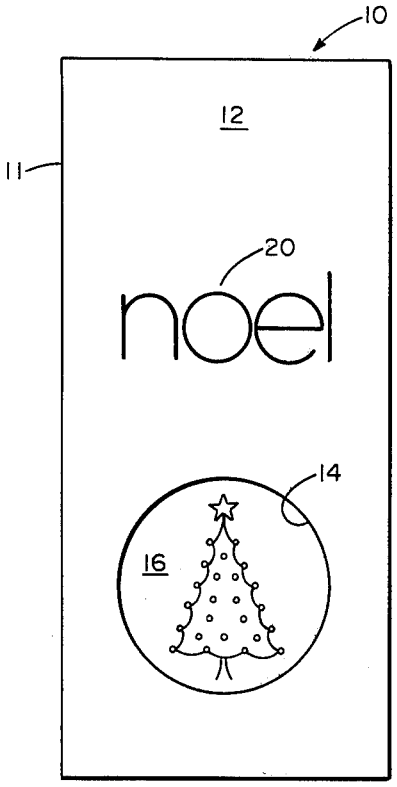
FIG. 1 is a front view of the greeting card.
Figure 2:
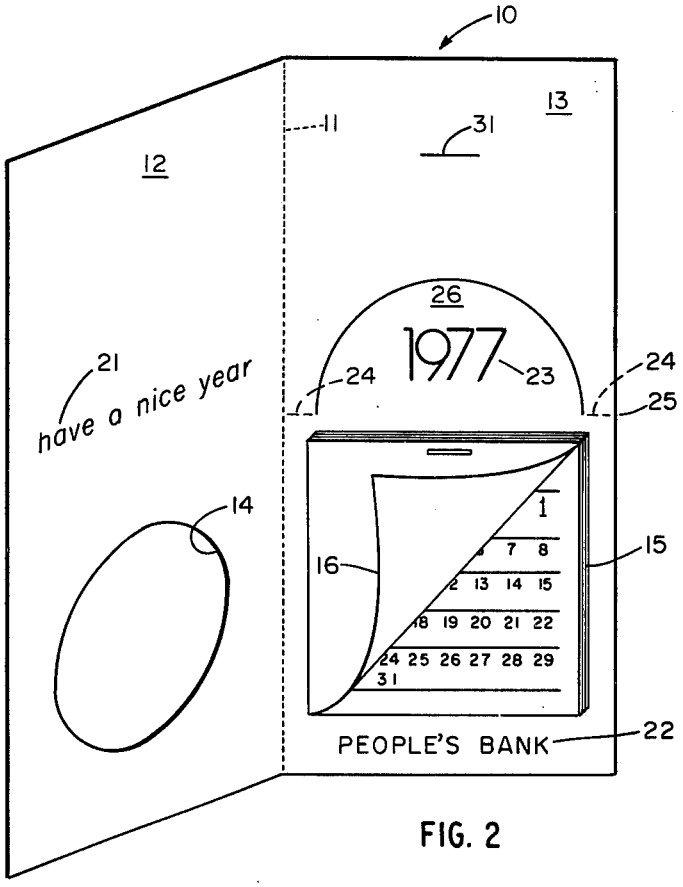
FIG. 2 is a view of the card in its open position.
Figure 3:
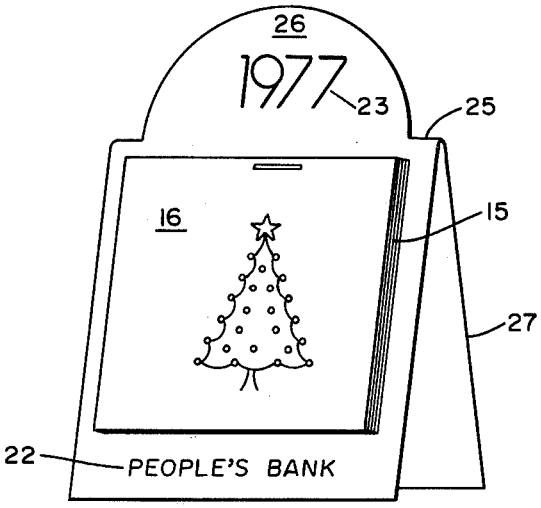
FIG. 3 is a perspective view of the easel supporting and displaying the calendar, formed from the back panel of the card.

With reference to the drawing, the card of this invention comprises a sheet generally indicated at 10 preferably of a card stock that may be white or colored, mat, smooth or glossy as desired, folded but once along a vertical edge (when the card is oriented for reading the message thereon) 11 to form front panel 12 and back panel 13.

The front panel has an aperture 14 which while it may be of any desired shape and located in any artful position on the card, is preferably circular and is preferably located in the lower portion of the front panel as shown. Aperture 14 could have an outlining configuration to better display the material on the back panel.

A calendar 15 is located on back panel 13 so that it is centered underneath aperture 14 for viewing. The calendar 15 may consist of but a single sheet and/or may be directly printed on the back panel but is preferably a series of tear off sheets each of which contains a calendar for the months of the year. Overlaying the calendar 15 is a cover page 16 that preferably has an artful design thereon, as shown, and which is pleasantly viewable through the aperture 14 when the card is in the closed position.

The card contains a greeting as illustrated at 20 and 21 and in its most useful embodiment would also carry an advertising message as at 22 or at 23 associated with the calendar pad and to be displayed therewith as the calender is used. While as illustrated the year is shown at 23, this could be as well be an advertising message.

The back panel is scored and die cut as at 24 to permit it to be folded horizontally at line 25 into a triangular easel shape leaving a display tab or pop-up 26 formed by score line 24 upstanding which display tab can carry message 23. Line 24 can of course be of any artful configuration. For example it could outline and thus highlight and advertisers logo. In some instances it is desirable to also have a portion or all of the message or art work in tab 26 viewable through aperture 14 when the card is in the closed position.

Figure 4:
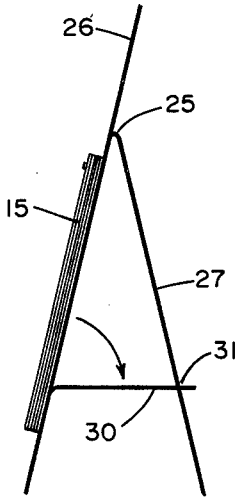
FIG. 4 is a side elevational view of the easel shown in FIG. 3.

Preferably the back panel 13 is also scored behind the calendar 15 to provide a locking tab 30 as shown in FIG. 4 that can be bent downwardly to help form and hold the easel in its shape. A slot 31 may be cut into back panel 13 to receive the locking tab 30 when that portion of 27 of back panel 13 is bent down around line 25 onto place to form the easel. The calendar pad can be mounted to the back panel by a staple, hot melt adhesive or such other means as desired. Top page 16 of the calendar could well be a personal photograph to be removed and kept by the recipient.

Preferably the whole of the card is of size and shape to be mailable to a conventional manner. Generally speaking a card that is about twice as high as it is wide is preferred as it permits the formation of the easel having a desirable size and shape.

Other methods of permitting usual separation of the front panel 12 from the back panel 13 will occur to the skilled in the art. For example, while normally a single sheet 10 will be used so that only a single sheet need be printed, panels 12 and 13 could be separated, be printed separately, and be joined by an easily tearable tissue hinge or by a removeable strip of pressure sensitive tape. The tear line 11 of perforations need not coincide with the fold line.

What is claimed is:

1. A greeting card having a height at least twice its width and comprising:

a. a single sheet of card stock folded along a vertical side thereof when the greeting of said card is oriented for reading and forming thereby a front panel and a back panel, said front panel having an aperture in the lower portion of the panel, the fold between said panels being perforated to permit ready manual separation of said panels, and said back panel being scored and adapted when separated from said front panel to being folded into an easel supporting and displaying a tablet, said easel being triangular in shape when viewed from the side and being formed by folding said back panel approximately in half along a horizontal line; and b. a tablet mounted on said back panel for viewing through said aperture when said card is in the closed position and for display on said easel, said tablet comprising a detachable cover page with a display thereon and thereunder additional pages.

2. The greeting card of claim 1 wherein said greeting is located on the face of said front panel and is suitable for the Christmass season and said tablet is a calendar pad.

3. The greeting card of claim 1 wherein said back panel is scored to provide a locking tab and receptive slot therefor as means for holding said triangular shape and to provide a display tab above said tablet and wherein said aperture is round.

* * * * *